United States Patent [19]

Schmidt, Jr. et al.

[11] 4,186,363

[45] Jan. 29, 1980

[54] SOLENOID ASSEMBLY FOR ELEVATED TEMPERATURE SERVICE

[75] Inventors: John Schmidt, Jr., Mount Prospect; Donald E. Martin, North Aurora, both of Ill.

[73] Assignee: Eaton Corporation, Clevelend, Ohio

[21] Appl. No.: 928,122

[22] Filed: Jul. 26, 1978

Related U.S. Application Data

[63] Continuation of Ser. No. 825,806, Aug. 18, 1977, abandoned.

[51] Int. Cl.[2] ..... H01F 7/16

[52] U.S. Cl. ..... 335/278; 335/202; 336/198

[58] Field of Search ..... 335/278, 260, 202, 255; 336/198, 90, 96

[56] References Cited

U.S. PATENT DOCUMENTS

| | | | |
|---|---|---|---|
| 3,226,606 | 12/1965 | Erickson | 335/260 |
| 3,230,490 | 1/1966 | Johnson | 336/198 |
| 4,041,430 | 8/1977 | Hrynewycz | 335/278 |

*Primary Examiner*—Harold Broome

*Attorney, Agent, or Firm*—R. J. McCloskey; R. A. Johnston; E. Crist

[57] ABSTRACT

A solenoid assembly for high-temperature service having a flanged housing, cover plate, and coil bobbin molded from high-temperature resistant thermosetting plastic. The coil terminals are located over lug projections integrally molded into the flanged portion of the housing to prevent pull-out. The coil bobbin is received in the housing and the cover plate interlocks axially thereover to capture the coil bobbin therein. The components are retained as an assembly by a surrounding pole frame.

22 Claims, 6 Drawing Figures

SOLENOID ASSEMBLY FOR ELEVATED TEMPERATURE SERVICE

This is a continuation of application Ser. No. 825,806, filed Aug. 18, 1977, and now abandoned.

BACKGROUND OF THE INVENTION

This invention relates to insulated electrical coil assemblies for high temperature service typically finding use in solenoids, relays, and other electrical equipment requiring coils.

Presently, electrical coil assemblies are generally wound of insulated wire on a thermoplastic or thermoset bobbin. The wound coil is then varnish impregnated and wrapped with insulating tape. Space is left in the insulating tape for the exit of the coil leads. In the known techniques connecting terminals were then attached to the leads. A final wrap of tape is then required to position and secure the terminals. However, due to the nature of the assembly, the terminals were subject to damage from pull-out or other abuse encountered during handling and assembly.

Another prior art method employs wire wrapped about a plastic bobbin molded from a resilient thermoplastic material. The thermoplastic bobbin is contained in a housing formed from a similar thermoplastic material, when then relies upon a detent or snapin retaining method which is compatible with the resilient nature of the thermoplastic. An example of this latter type of assembly is described in U.S. Pat. No. 3,230,490. However, the relatively low temperature resisting properties of the thermoplastic family of materials as compared with the temperature resisting properties now available with the family of thermosetting plastics, prohibits the use of thermoplastic coil assemblies in high temperature environments.

A further prior art method employs "potting" the wound coil by pouring thermosetting resin around the coil as placed in a mold. This is a costly technique but heretofore has been the only thermoset encapsulation approach available since the temperatures and pressures encountered while injection molding a thermoset material around a coil caused damage to the winding insulation.

In view of the temperature limitations of thermoplastic material, the high cost of "potting" a wound coil with thermoset material, the high cost and inherent performance problems experienced with tape wound assemblies, plus the present inability of injection molding a thermoset material around a wound coil, a superior and more economical means of employing heat resisting thermoset materials has been sought.

SUMMARY OF THE INVENTION

The present invention provides a solution to the above-described problem by providing a low-cost electrical solenoid or coil assembly that can be used in elevated temperature environments and retain the functional integrity of its electrical insulation. The coil assembly of the present invention employs a coil wound on a bobbin of thermosetting material received in a housing formed of thermosetting material. The bobbin has a terminal attachment portion formed on one end flange with a pair of spaced electrical terminals attached thereto. The housing has a terminal encasing portion formed on one end thereof, and the bobbin, with terminals attached, is received in the housing with the terminals interlocking retaining lugs provided in the housing. A cover plate is received over the end of the bobbin and terminals and has portions thereof interlocking with corresponding portions of the housing to prevent rotation of the coil and terminals with respect to the housing. The components are retained in axial assembly by a surrounding pole frame which has apertures provided in opposite sides thereof for receiving the armature therethrough and into the interior of the hollow bobbin. A pole piece is attached through one of the apertures in the pole frame to provide the desired magnetic attraction forces, and the end of the armature adjacent to the pole piece employs a shaded pole construction.

The ends of the bobbin have protrusions formed thereon which engage the aperture in the pole frame to register and locate the bobbin and housing assembly in the pole frame.

The present invention thus provides a unique coil assembly which has a housing, a bobbin and cover plate formed of thermosetting material resistant to elevated temperatures and the components are maintained in a coil encapsulating assembly by the surrounding pole frame without the need for adhesives or other joining techniques.

DETAILED DESCRIPTION OF THE PREFERRED EMBODIMENTS

Figure 1:
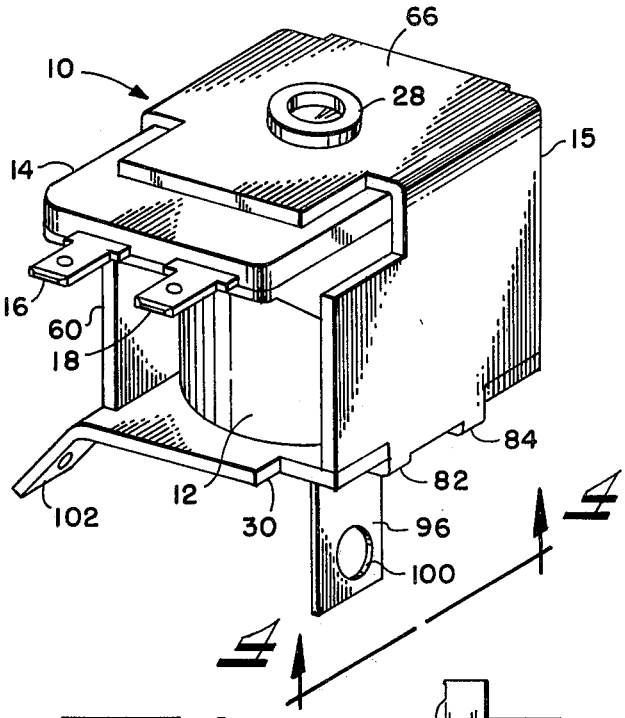
FIG. 1 is an isometric view of the solenoid assembly.

There is shown in FIG. 1 a solenoid assembly, indicated generally at 10, which comprises a housing member 12, a front cover plate 14 and a pole frame 15 surrounding housing member 12 and front cover plate 14. A pair of spaced electrical terminals 16 and 18 extend from the parting line between cover plate 14 and housing 12.

Figure 2:
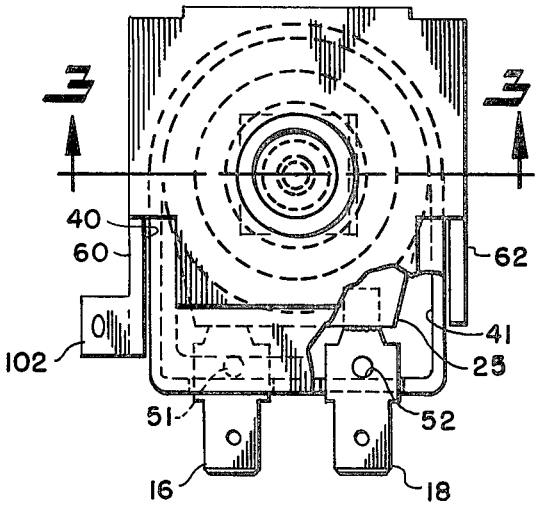
FIG. 2 is a top plan view in elevation of the solenoid assembly of FIG. 1.
Figure 3:
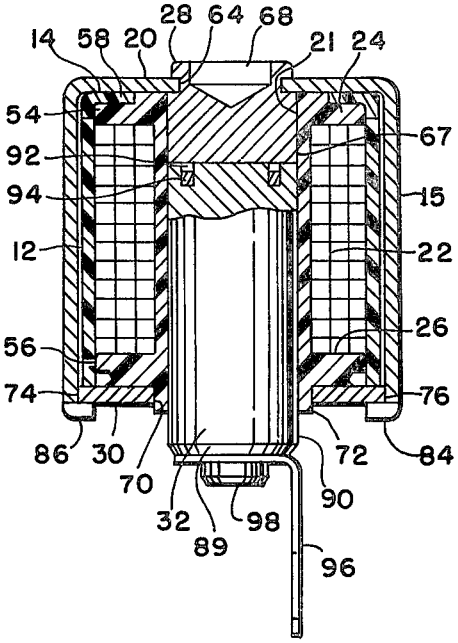
FIG. 3 is a section view taken along section indicating lines 3—3 of FIG. 2.

Referring now to FIG. 3, a hollow bobbin 20 having end flanges 24 and 26, is slidably received within housing 12. The upper bobbin flange has a truncated tapered configuration on one peripheral half thereof forming a terminal mounting portion 25 which has recesses formed therein (not shown) for receiving electrical terminals therein. Each of the bobbin flanges has a raised circular shoulder provided on the end face thereof. Wrapped around the hollow bobbin 20 is a coil 22 of electrically conductive material, which substantially fills a space defined by an upper bobbin flange 24 and a lower bobbin flange 26. The electrical terminals 16 and 18 are attached to the upper bobbin flange 24 by inserting portions thereof into the aforementioned recesses, one of which is shown by the dashed line in FIG. 2, which are provided in flange portion 25 as will be readily understood by those skilled in the art.

Figure 5:
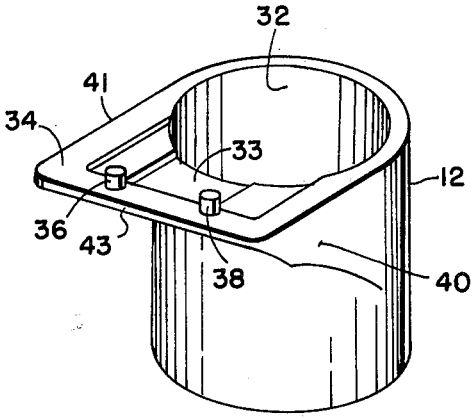
FIG. 5 is an isometric view of the housing of the embodiment of FIG. 1 showing the terminal locating lugs in the cover section of the housing.

As shown in FIG. 5, the housing 12 has a generally cylindrical shape, having a bore 32 therethrough with a terminal cover portion 34 integrally formed at one end of the housing and projecting transversely and to one side of the axis defined by the housing bore. The cover portion 34, in the presently preferred practice, has a generally rectangular shape in plan view. The sides of the terminal cover portions 40 and 41, only one side 40 being shown in FIGS. 2 and 5, are flat with a width equal to the diameter of the housing with the end 43 disposed generally at right angles to the sides. Projecting upwardly from the face of the terminal cover portion 34 is a pair of upstanding spaced lugs 36 and 38 which are molded into the upper face of the end 43.

Figure 6:
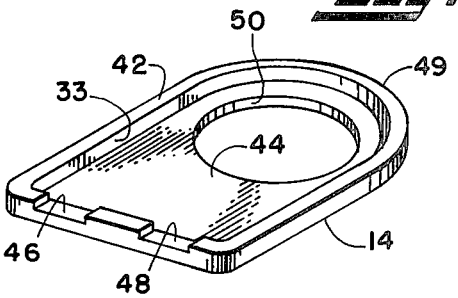
FIG. 6 is an isometric view of the cover plate.

Referring now to FIG. 6, the cover plate 14 is generally rectangular in shape having one end 49 rounded to conform with the cylindrical portion of housing 12 at the terminal cover portion. The periphery of the cover plate has a rim portion 42, having a rectangular transverse section, projecting upwardly from the bottom surface 44 of the cover plate. Notches 46 and 48 are molded into the face of rim 42 along the straight end interconnecting the parallel curved sides of cover plate 14. A hole 50 is also molded into the cover plate 14 and is concentric with the rounded end 49. A recess 33 is formed in the upper face of the cover portion and is suitably configured for nesting therein portion 25 of the bobbin flange 24.

In the presently preferred practice, the housing, bobbin and cover plate are formed of nonconductive nonmagnetic material resistant to and capable of sustained exposure to temperatures of 155° C. without any degradation of the insulating properties thereof. Preferably a thermosetting plastic as, for example, a suitable phenolic type may be used. However, ceramic materials may also be used.

At assembly, the hollow bobbin 20 with the coil 22 wound thereon and the terminals 16 and 18 are attached to the upper bobbin flange 24 by inserting the base portion of each terminal into one of the aforementioned recesses formed in the end of portion 25 of the bobbin flange. Each terminal has a hole 51, 52 therein for locating purposes as will hereinafter be described. The ends of the coil 22 are then attached each to, respectively, one of the terminals 16, 18. The attachment may be by any suitable expedient known in the art as, for example, wrapping and soldering. The bobbin, with coil and terminals assembled thereon, is then received in bore 32 so that the terminals, locating holes 52 and 50, fit over the projecting lugs 36 and 38 to prevent rotation of the bobbin-coil assembly. The engagement of lugs 36 and 38 with the electrical terminals also serves to prevent removal of the terminals from the bobbin flange.

As best shown in FIG. 3, the upper bobbin flange 24 has an outer edge 54 which locates within the bore 32 of housing 12. Similarly, the lower bobbin flange 26 has an outer peripheral edge 56 which is sized to interfit in bore 32 in housing 12. The outer edges of the bobbin flanges then locate and serve to stabilize the bobbin-coil assembly within the housing 12. With the bobbin coil assembly placed within the housing as described above, cover plate 14 is fitted over the terminal cover portion of the housing with the rim 42 contacting the upper face of the housing cover portion. The notches 46 and 48 are received over and are sized to provide clearance for the terminals 16, 18. The hole 50 locates over a circular shoulder or locating diameter defined by the edge 58 projecting from the face surface of the upper bobbin flange. It can now be seen that the electrical coil is encapsulated by housing 12, cover plate 14 and the upper and lower bobbin flanges. The aforementioned components are molded from a high temperature resistant thermosetting phenolic which provides excellent structural rigidity and insulating properties under high temperature conditions. It will be understood that if only an insulated coil is required rather than a complete solenoid assembly, then the mating surfaces of the cover plate and terminal cover portion of the housing could be adhesively bonded together as a single unit to provide a coil subassembly.

Figure 4:
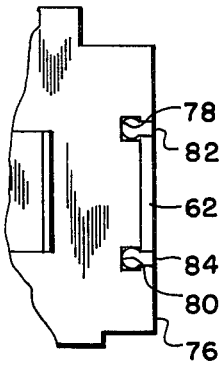
FIG. 4 is a fragmentary bottom view of FIG. 1 showing the locking tabs of the U-frame.

Referring now to FIGS. 1 and 3, the pole frame 15 has a rectangular section and is formed of ferromagnetic material formed into a generally U-shaped configuration with the sides of the U-shape spaced to conform to the external axial length of the housing bobbin and cover subassembly. The sides 60, 62 of the bracket are flush with the sides 40 and 41 of the terminal cover portion, thus preventing rotation of the housing with respect to the bracket assembly. A hole 64 is located centrally in the flat surface 66 of the pole frame and has received therein a pole piece 28. The pole piece has a generally cylindrical configuration having a diameter 67 which conforms to the bore diameter 21 of the hollow bobbin and is sized for a sliding fit therein. A tubular shoulder projection 68 on one end of the pole piece serves to locate the pole piece in the hole 64 of the pole frame. The thin wall of the tubular shoulder 68 is then deformed outwardly, as, for example, by spinning over the hole 64. The pole piece thus locates the pole frame with respect to the bore of the hollow bobbin. The bottom plate 30 of the pole frame 15 is provided with a centrally located hole 70 which fits over a raised diameter or shoulder 72 formed on the end face of flange 76 of the hollow bobbin. The bottom pole frame plate, also formed of ferromagnetic material, has a width sufficient to span the distance between the sides of the pole frame, and has a grounding tab 102 formed integrally thereon. The sides 74 and 76 of the bottom pole frame plate preferably each have a pair of notches 78 and 80 as shown typically for pole frame side 62 in FIG. 4 to receive crimping tabs 82 and 84 located at one end of the pole frame. A similar pair of crimping tabs are typically present on the other end of the pole frame, one such tab 86 being shown in FIG. 3. After the tabs are crimped into place, the pole frame and bottom pole frame plate 30 form a continuous loop of ferromagnetic material which encircles or surrounds the encapsulated coil. This unique interlocking relationship of the components minimizes assembly costs. Referring to FIG. 3, an armature 89 having a cylindrical shape with a diameter 90 sized for a sliding fit within the bore 21 of the bobbin is slidably received through hole 70 in the bottom plate 30 of the pole frame with one end extending outwardly from the bottom plate 30. The end of the armature received within the coil bobbin has an annular groove 92 formed therein, which groove contains a shading ring 94 formed from copper which functions to delay the flow of magnetic flux about a path through the pole frame, the bottom pole frame plate, the armature, and the pole piece. Attached to the end of the armature opposite the shading ring is a preferably L-shaped bracket 96 which has an aperture 100 therein is received over a projection 98 formed on the end face of the armature. The projection 98 is deformed slightly as, for example, by staking to retain the bracket thereon. When the coil is energized with alternating current, variations in the flow of magnetic flux induce a current flow in the shading ring. The induced current in the shading ring also generates a magnetic flux, the effect of which is to insure that at least some flux flows between the armature and pole piece when the current through the coil changes phase and passes through a point of zero magnitude. The use of a shading ring in a magnetic circuit is well known and prevents chatter or vibration of the armature in an alternating current solenoid.

It will thus be seen that the unique simplicity inherent in the configuration of the front cover plate, housing and bobbin results in a low cost thermoset molded electrical coil assembly for use in solenoid assemblies and related electrical equipment.

The embodiments of the invention as shown and described above are representative of the inventive principles as stated herein. It is to be understood that variations and departures can be made from the embodiments as shown without, however, departing from the scope of the appended claims.

What is claimed is:

1. A solenoid assembly for elevated temperature service comprising:

(a) a housing formed of insulating material and having a bore therethrough and having a terminal cover portion integrally formed at one end thereof and extending therefrom in a transverse direction to said bore, said cover portion having a certain surfaces thereof adapted for locating and registering electrical connectors;

(b) a hollow bobbin formed of insulating material and having a pair of axially spaced end flanges extending therefrom;

(c) a coil of electrically conductive material received over said bobbin intermediate said flanges with the ends of said coil terminating adjacent one of said flanges;

(d) a pair of spaced electrical terminals attached to said one flange and extending therefrom in a direction generally transverse to the axis of said coil with the ends of said coil connected to said terminals, said bobbin being received in said housing bore with said electrical terminals engaging said certain surfaces so as to locate and register said bobbin and electrical terminals and prevent relative rotation of said bobbin in said housing;

(e) a cover plate formed of insulating material received over said cover portion of said housing, said one bobbin end flange and said terminals with the periphery thereof generally conforming to the periphery of said housing cover portion, said cover plate having an aperture therein for permitting access to the hollow of said bobbin, wherein said housing, bobbin and cover plate are formed of material capable of sustained operation at temperatures of at least 155° C. without degradation of the insulating properties thereof;

(f) a pole frame formed of ferromagnetic material, said frame being received over said housing and cover plate and having a pair of opposite sides thereof spaced so as to retain said cover plate on said housing, with one of said sides having an aperture formed therein for permitting access to the hollow of said bobbin, said pole frame surrounding said housing so as to provide a continuous magnetic flux loop about said coil; and (g) an armature formed of ferromagnetic material slidably received through said side face aperture and extending into the hollow of said bobbin.

2. The solenoid assembly defined in claim 1, wherein said pole frame has a pole piece portion extending from the side opposite said armature receiving side and into said hollow bobbin for forming a pole magnetically opposite said armature and for locating the air gap for one end of said armature intermediate the ends of said coil.

3. The solenoid assembly defined in claim 1, wherein said housing cover plate, base plate and bobbin are formed of high temperature thermosetting plastic material.

4. The solenoid assembly defined in claim 1, wherein said certain surfaces of said cover portion of said housing include lug means engaging co-operating surfaces of said electrical terminals for resisting withdrawal of same from said bobbin upon said terminals being subjected to external connection and disconnection thereto.

5. The solenoid assembly defined in claim 1, wherein the end of said armature defining said pole piece air gap has an annular ring provided thereon, said ring being formed of material having lower magnetic permeability than said armature material for providing a shaded pole on said armature.

6. The solenoid assembly defined in claim 5, wherein said annular ring is formed of copper.

7. An encapsulated coil assembly for high temperature service comprising:

(a) a tubular housing having formed integrally therewith a terminal cover portion extending therefrom adjacent one end thereof and in a direction generally transverse to the inner periphery thereof, said housing being formed of electrically nonconductive and nonmagnetic material;

(b) a bobbin formed of electrically nonconductive and nonmagnetic material and having a bore longitudinally therethrough with a pair of axially spaced flanges extending outwardly therefrom adjacent the ends thereof with one of said flanges having a portion thereof recessed for attachment of electrical terminals thereto;

(c) a coil of electrically conductive material received over said bobbin intermediate said flanges with the ends of said conductor terminating adjacent a common one of said flanges;

(d) a pair of spaced electrical terminals received over said one recessed portion of said flange with said conductor ends attached respectively to each of one of said terminals;

(e) a cover plate formed of nonmagnetic insulating material received over said one end of said bobbin; said cover portion and said terminals with said terminals extending from said cover portion, said cover plate having an aperture therein for permitting access to the bobbin bore, said cover portion of said housing including lug means engaging co-operating surfaces on each of said terminals to prevent movement of said bobbin in said housing, said cover plate having the periphery thereof joined to the outer periphery of said cover portion of said housing with the bobbin end flange opposite said terminals having the periphery thereof joined to the end of said tubular housing to thereby encapsulate said coil.

8. The coil assembly defined in claim 7, wherein said housing, bobbin and cover plate are formed of thermosetting insulating material capable of sustained operation at temperatures of at least 155° C. without degradation of the insulating properties thereof.

9. The device defined in claim 7, wherein said electrical terminals each have an aperture formed therein and said lug means includes a plurality of lugs with each of said terminal apertures received over one of said lugs.

10. An insulated electrical solenoid assembly comprising:

(a) a housing sleeve formed of electrical insulating material;

(b) a bobbin having a coil wound thereon and terminating in a pair of spaced terminals disposed at a common end thereof;

(c) locking means affixed to one end of said sleeve for locking the coil terminals and the coil against rotation in said sleeve;

(d) a cover of insulating material having a plurality of openings therein with each of said terminals received in one of said openings and extending therethrough for engaging said locking means, said housing sleeve, bobbin and cover being formed of insulating material capable of sustained operation at temperatures of 155° C. without degradation of the insulating properties thereof; and, (e) pole frame means of ferromagnetic material for retaining said coil, cover, sleeve and base plate in fixed assembly wherein said pole frame provides a return path for a magnetic flux generated by said coil assembly.

11. An insulated electrical coil assembly as defined in claim 10 wherein said locking means comprises a pair of upwardly extending projections for locating said terminals thereon.

12. An insulated electrical coil assembly as defined in claim 11 wherein said cover has a pair of notches spaced along the mating edge that engages the locking end of said sleeve.

13. An insulated electrical coil assembly as defined in claim 12 wherein said retaining means comprises a U-shaped bracket formed to surround said coil assembly while contained within said cover, sleeve and base plate.

14. An insulated electrical coil assembly as defined in claim 13 wherein said cover and said sleeve are molded from a high temperature resistant phenolic.

15. A solenoid assembly for elevated temperature service, comprising:

(a) a housing formed of insulating material and having a bore and having a terminal cover portion integrally formed at one end thereof and extending therefrom in a transverse direction to said bore;

(b) a hollow bobbin formed of insulating material and having a pair of axially spaced end flanges extending therefrom;

(c) a coil of electrically conductive material received over said bobbin intermediate said flanges with the ends of said coil terminating adjacent one of said flanges;

(d) a pair of spaced electrical terminals attached to said one flange and extending therefrom in a direction generally transverse to the axis of said coil with the ends of said coil connected to said terminals, said bobbin being received in said housing bore;

(e) a cover plate formed of insulating material received over said cover portion of said housing and said one bobbin end flange with the periphery thereof generally conforming to the periphery of said terminal cover portion, said cover plate having an aperture therein for permitting access to the hollow of said bobbin;

(f) said terminal cover portion and said cover plate cooperating to define means for registering and preventing movement of said terminals relative to said terminal cover portion and said cover plate;

(g) pole frame means formed of ferromagnetic material, said pole frame means being received over said housing and cover plate and having portions thereof spaced and operable to retain said cover plate on said housing, said pole frame means permitting access to the hollow of said bobbin, and being operable to provide a continuous magnetic flux loop about said coil; and (h) armature means formed of ferromagnetic material slidably received into the hollow of said bobbin.

16. The solenoid assembly as defined in claim 15, wherein said means for registering and preventing movement of said terminals includes lug means projecting from said terminal cover portion and engaging cooperating surfaces of said electrical terminals.

17. The solenoid assembly as defined in claim 15, wherein said means for registering and preventing movement of said terminals includes lug means projecting from said terminal cover portion and engaging cooperating surfaces of said electrical terminals, said lug means extending closely adjacent said cover plate.

18. The solenoid assembly as defined in claim 15, wherein said housing, said bobbin, and said cover plate are formed of material capable of sustained operation at temperatures of at least 155° C. without degradation of the insulating properties thereof.

19. A solenoid assembly for elevated temperature service comprising:

(a) housing means formed of insulating material, said housing means including, (i) body means having a bore formed therein and having a terminal cover portion integrally formed at one end thereof and extending therefrom in a generally transverse direction to said bore, (ii) cover plate means received over said terminal cover portion of said body means;

(b) a hollow bobbin formed of insulating material and having an end flange extending therefrom;

(c) a coil of electrically conductive material received over said bobbin with the ends of said coil terminating adjacent said end flange;

(d) a pair of spaced electrical terminals attached to said flange and extending therefrom in a direction generally transverse to the axis of said coil with the ends of said coil connected to said terminals, said bobbin being received in said body means bore;

(e) said cover plate means received over said terminal cover portion of said body means, said end flanges and said terminals with the periphery thereof generally conforming to the periphery of said terminal cover portion, said cover plate means permitting access to the hollow of said bobbin;

(f) said housing means including means for registering and preventing movement of said terminals relative to said terminal cover portion and said cover plate;

(g) pole frame means formed of ferromagnetic material, said pole frame means being received over said body means and said cover plate means and having portions thereof spaced so as to retain said cover plate means on said body means and operative to permit access to the hollow of said bobbin, said pole frame means providing a continuous magnetic flux loop about said coil; and (h) armature means formed of ferromagnetic material slidably received into the hollow of said bobbin.

20. The solenoid assembly as defined in claim 19, wherein said means for registering and preventing movement of said terminals includes lug means projecting from said terminal cover portion of said body means and engaging cooperating surfaces of said electrical terminals.

21. The solenoid assembly as defined in claim 19, wherein said means for registering and preventing movement of said terminals includes lug means projecting from said terminal cover portion of said body means and engaging cooperating surfaces of said electrical terminals, said lug means extending closely adjacent said cover plate means.

22. The solenoid assembly as defined in claim 19, wherein said body means, said bobbin, and said cover plate means are formed of material capable of sustained operation at temperatures of at least 155° C. without degradation of the insulating properties thereof.

* * * * *